US006382451B1

(12) United States Patent
Di Filippo et al.

(10) Patent No.: US 6,382,451 B1
(45) Date of Patent: May 7, 2002

(54) FLEXIBLE COVER DEVICE FOR A RECYCLE CONTAINER

(76) Inventors: Michael A. Di Filippo; Teresa M. Di Filippo, both of 205 Livingston Ave., Grimsby, Ontario (CA), L3M 4S8

( * ) Notice: Subject to any disclaimer, the term of this patent is extended or adjusted under 35 U.S.C. 154(b) by 73 days.

(21) Appl. No.: 09/627,698

(22) Filed: Jul. 28, 2000

(51) Int. Cl.[7] ..... B65D 45/16

(52) U.S. Cl. ..... 220/324; 220/315; 428/99; 428/100

(58) Field of Search ..... 428/99, 100; 217/124; 220/315, 326, 324

(56) References Cited

U.S. PATENT DOCUMENTS

| | | | |
|---|---|---|---|
| 3,074,452 A | 1/1963 | Bridges | |
| 3,322,176 A | 5/1967 | Geller | |
| 3,924,802 A | 12/1975 | Gaffney | |
| 5,390,813 A | 2/1995 | Anderson et al. | |
| 5,410,982 A | 5/1995 | Mann | |
| D384,273 S | 9/1997 | Willis | |
| 5,819,974 A | * 10/1998 | Caldwell | 220/315 |

* cited by examiner

*Primary Examiner*—Alexander S. Thomas

(57) ABSTRACT

A flexible cover device for a recycle container for keeping recyclable articles within the container. The flexible cover device for a recycle container includes a net member being made of mesh material; and also includes a first elongate support member being securely attached along a first end edge of the net member and being adapted to be fastenable with fasteners upon a container; and further includes a second elongate support member being securely attached along a second end edge of the net member; and also includes a plurality of elongate elastic members each of which is securely attached along a respective side edge of the net member; and also includes fastening members spaced along and being securely attached to the second elongate support member and being adapted to fasten to a top of the container for securely disposing the net member upon an open top of the container; and further includes a handle member securely attached to the second elongate support member and extending therefrom.

8 Claims, 2 Drawing Sheets

FLEXIBLE COVER DEVICE FOR A RECYCLE CONTAINER

BACKGROUND OF THE INVENTION

1. Field of the Invention

The present invention relates to a net covering for a recycle box and more particularly pertains to a new flexible cover device for a recycle container for keeping recyclable articles within the container.

2. Description of the Prior Art

The use of a net covering for a recycle box is known in the prior art. More specifically, a net covering for a recycle box heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,410,982; U.S. Pat. No. 3,322,176; U.S. Pat. No. 5,390,813; U.S. Pat. No. 3,074,452; U.S. Pat. No. 3,925,802; and U.S. Pat. No. Des. 384,273.

While these devices fulfill their respective, particular objectives and requirements, the aforementioned patents do not disclose a new flexible cover device for a recycle container. The inventive device includes a net member being made of mesh material; and also includes a first elongate support member being securely attached along a first end edge of the net member and being adapted to be fastenable with fasteners upon a container; and further includes a second elongate support member being securely attached along a second end edge of the net member; and also includes a plurality of elongate elastic members each of which is securely attached along a respective side edge of the net member; and also includes fastening members spaced along and being securely attached to the second elongate support member and being adapted to fasten to a top of the container for securely disposing the net member upon an open top of the container; and further includes a handle member securely attached to the second elongate support member and extending therefrom.

In these respects, the flexible cover device for a recycle container according to the present invention substantially departs from the conventional concepts and designs of the prior art, and in so doing provides an apparatus primarily developed for the purpose of keeping recyclable articles within the container.

SUMMARY OF THE INVENTION

In view of the foregoing disadvantages inherent in the known types of net covering for a recycle box now present in the prior art, the present invention provides a new flexible cover device for a recycle container construction wherein the same can be utilized for keeping recyclable articles within the container.

The general purpose of the present invention, which will be described subsequently in greater detail, is to provide a new flexible cover device for a recycle container which has many of the advantages of the net covering for a recycle box mentioned heretofore and many novel features that result in a new flexible cover device for a recycle container which is not anticipated, rendered obvious, suggested, or even implied by any of the prior art net covering for a recycle box, either alone or in any combination thereof.

To attain this, the present invention generally comprises a net member being made of mesh material; and also includes a first elongate support member being securely attached along a first end edge of the net member and being adapted to be fastenable with fasteners upon a container; and further includes a second elongate support member being securely attached along a second end edge of the net member; and also includes a plurality of elongate elastic members each of which is securely attached along a respective side edge of the net member; and also includes fastening members spaced along and being securely attached to the second elongate support member and being adapted to fasten to a top of the container for securely disposing the net member upon an open top of the container; and further includes a handle member securely attached to the second elongate support member and extending therefrom.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flexible cover device for a recycle container which has many of the advantages of the net covering for a recycle box mentioned heretofore and many novel features that result in a new flexible cover device for a recycle container which is not anticipated, rendered obvious, suggested, or even implied by any of the prior art net covering for a recycle box, either alone or in any combination thereof.

It is another object of the present invention to provide a new flexible cover device for a recycle container which may be easily and efficiently manufactured and marketed.

It is a further object of the present invention to provide a new flexible cover device for a recycle container which is of a durable and reliable construction.

An even further object of the present invention is to provide a new flexible cover device for a recycle container which is susceptible of a low cost of manufacture with regard to both materials and labor, and which accordingly is then susceptible of low prices of sale to the consuming public, thereby making such flexible cover device for a recycle container economically available to the buying public.

Still yet another object of the present invention is to provide a new flexible cover device for a recycle container which provides in the apparatuses and methods of the prior art some of the advantages thereof, while simultaneously overcoming some of the disadvantages normally associated therewith.

Still another object of the present invention is to provide a new flexible cover device for a recycle container for keeping recyclable articles within the container.

Yet another object of the present invention is to provide a new flexible cover device for a recycle container which includes a net member being made of mesh material; and also includes a first elongate support member being securely attached along a first end edge of the net member and being adapted to be fastenable with fasteners upon a container; and further includes a second elongate support member being securely attached along a second end edge of the net member; and also includes a plurality of elongate elastic members each of which is securely attached along a respective side edge of the net member; and also includes fastening members spaced along and being securely attached to the second elongate support member and being adapted to fasten to a top of the container for securely disposing the net member upon an open top of the container; and further includes a handle member securely attached to the second elongate support member and extending therefrom.

Still yet another object of the present invention is to provide a new flexible cover device for a recycle container that easily and conveniently covers an open top of a container being used to hold recyclable articles.

Even still another object of the present invention is to provide a new flexible cover device for a recycle container that can be easily and quickly attached to an open top container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
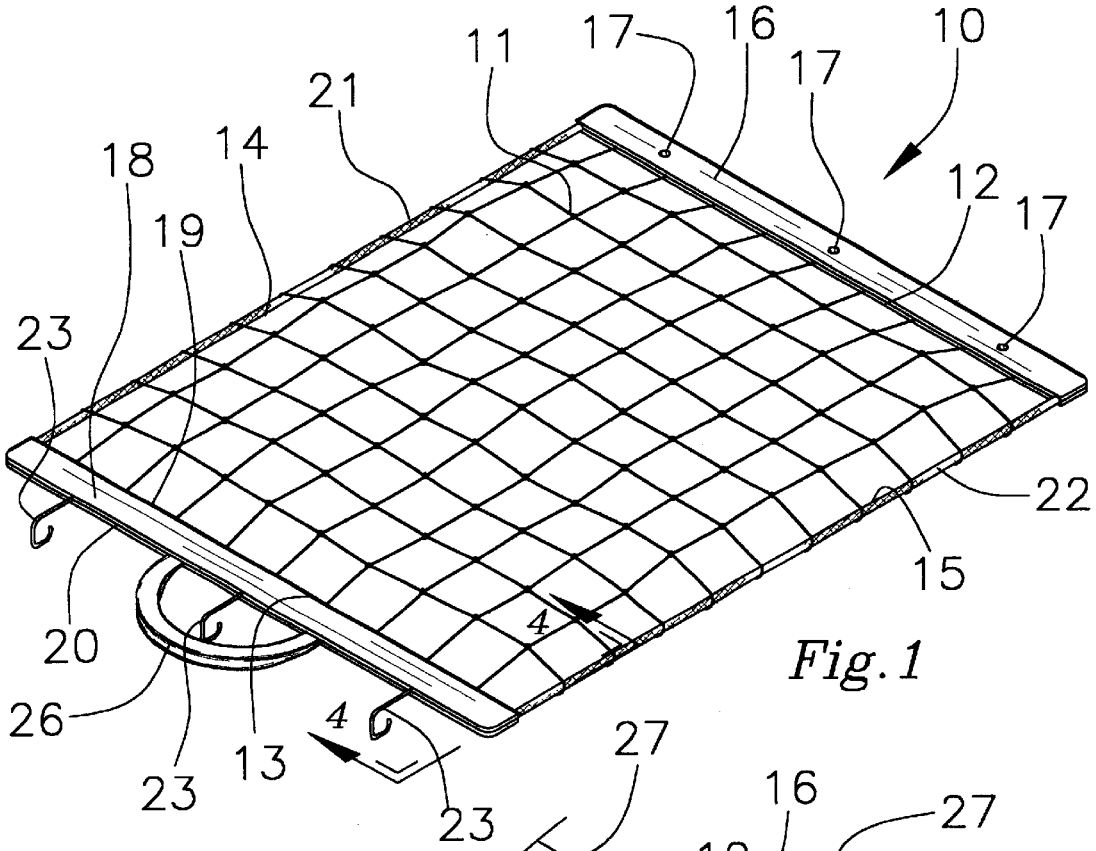
FIG. 1 is a perspective view of a new flexible cover device for a recycle container according to the present invention.
Figure 2:
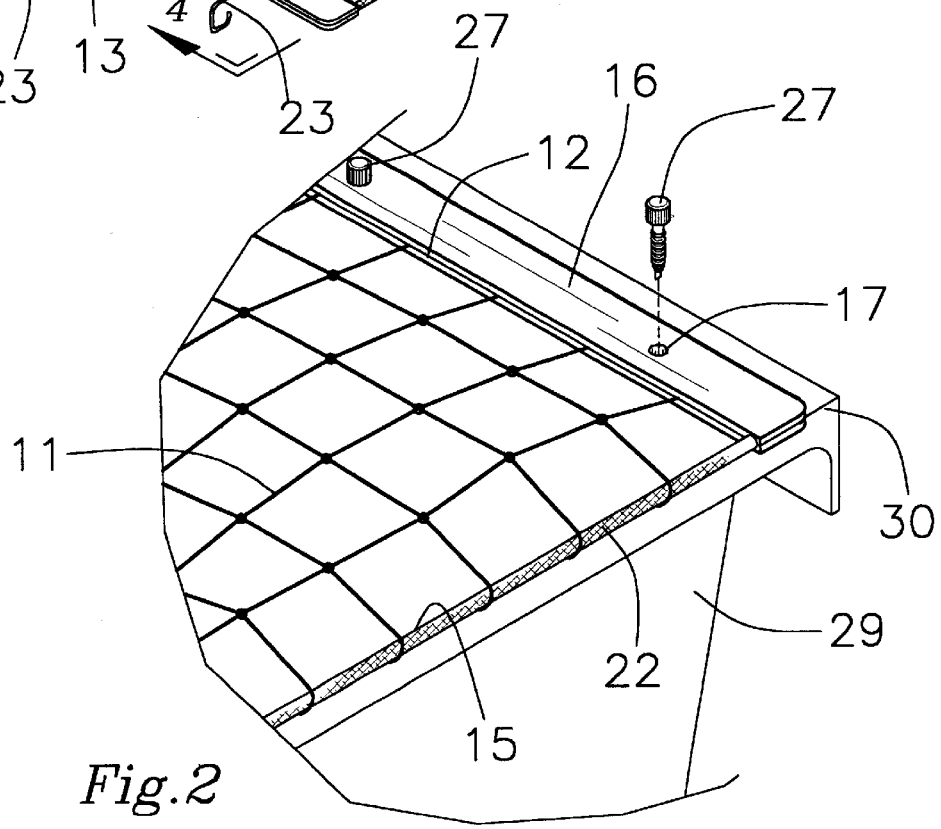
FIG. 2 is a partial perspective view of the present invention.
Figure 3:
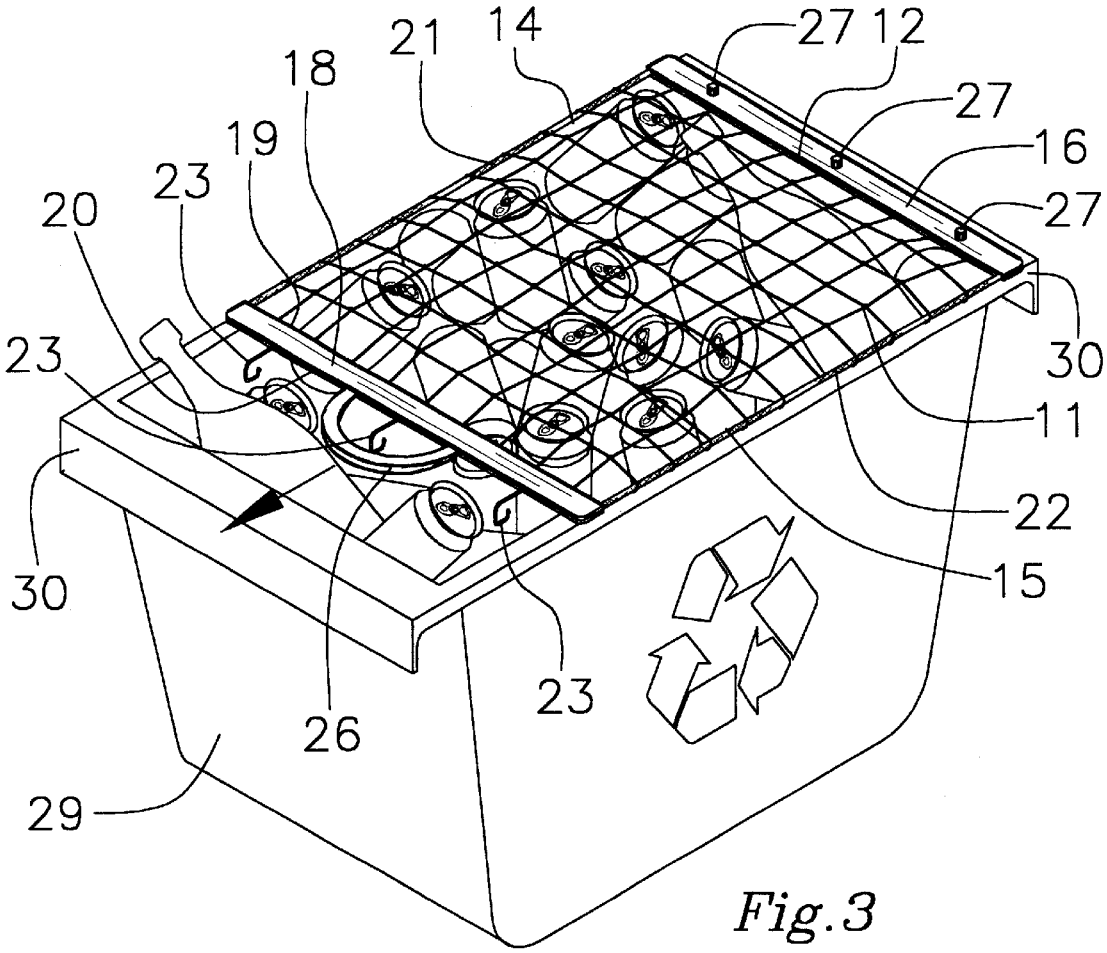
FIG. 3 is a perspective view of the present invention shown in use.
Figure 4:
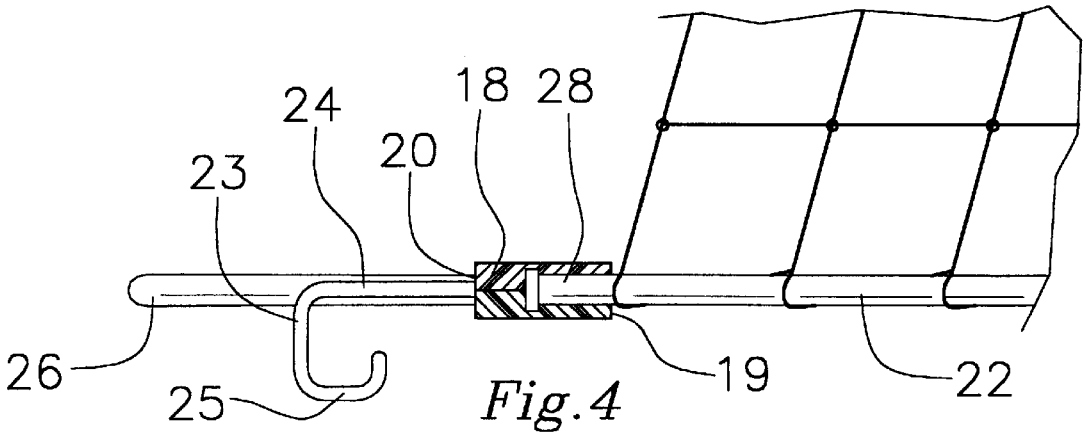
FIG. 4 is a partial cross-sectional view of the present invention.

With reference now to the drawings, and in particular to FIGS. 1 through 4 thereof, a new flexible cover device for a recycle container embodying the principles and concepts of the present invention and generally designated by the reference numeral 10 will be described.

As best illustrated in FIGS. 1 through 4, the flexible cover device for a recycle container 10 generally comprises a net member 11 being made of spaced mesh material. A first elongate support member 16 is adapted to be fastenable with fasteners 27 upon a container 29 and is securely and conventionally attached along a first end edge 12 of the net member 11 with the first end edge 12 of the net member 11 being securely disposed and retained through a side edge of the first elongate support member 16. The first elongate support member 16 includes a plurality of holes 17 spaced along and extending through the first elongate support member 16 and is adapted to receive the fasteners 27 for fastening the first elongate support member 16 along a top edge 30 of the container 19

A second elongate support member 18 is securely attached along a second end edge 13 of the net member 11 with the second end edge 13 of the net member 11 being securely disposed and retained in a first side edge 19 of the second elongate support member 18. The first 16 and second 18 elongate support members are essentially planar and have slots 28 extending in the side edge of the first elongate support member 16 and in the first side edge 19 of the second elongate support member 18 with the walls forming the slots 28 being corrugated and with the end edges 12,13 of the net member 11 being securely retained in the respective slots 28 thereof.

The flexible cover device 10 also includes a plurality of elongate elastic members 21,22 each of which is securely and conventionally attached along a respective side edge 14,15 of the net member 11 and each of which has ends which are securely and conventionally attached in the slots 28 of the first and second elongate support members 16,18. Each of the elongate elastic members 21,22 are woven through strands of mesh along a respective side edge 14,15 of the net member 11.

Fastening members 23 are spaced along and are securely and conventionally attached to the second elongate support member 18 and are adapted to fasten to a top 30 of the container 29 for securely disposing the net member 11 upon an open top of the container 30. Each of the fastening members 23 includes a stem portion 24 and a hook portion 25 integrally extending therefrom with the stem portion 23 being securely disposed in a longitudinal second side edge 20 of the second elongate support member 18. The fastening members 23 essentially extend outwardly of the second elongate support member 18 to effectively hook about a handle portion or lip portion 30 of the container 29 to secure the net member 11 over the open top of the container 29. A handle member 26 is securely and conventionally attached to the second elongate support member 18 and extend outwardly therefrom with the handle member 26 being securely disposed in an intermediate portion of the second side edge 20 of the second elongate support member 18 and extending outwardly therefrom to effectively allow a user to grasp and urge the net member 11 over the open top of the container 29.

In use, the user places recyclable articles in the recycle container 29 and secures the net member 11 over the open top of the recycle container 29 to substantially keep the objects inside the recycle container 29.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A flexible cover device for a recycle container comprising:

a net member being made of mesh material;

a first elongate support member being securely attached along a first end edge of said net member and being adapted to be fastenable with fasteners upon a container;

a second elongate support member being securely attached along a second end edge of said net member;

a plurality of elongate elastic members each of which is securely attached along a respective side edge of said net member and each of which has ends securely attached to said first and second elongate support members;

fastening members spaced along and being securely attached to said second elongate support member and being adapted to fasten to a top of the container for securely disposing said net member upon an open top of the container; and a handle member securely attached to said second elongate support member and extending therefrom.

2. A flexible cover member for a recycle container as described in claim 1, wherein said first and second elongate support members are essentially planar.

3. A flexible cover member for a recycle container as described in claim 2, wherein said first elongate support member includes a plurality of holes spaced along and extending through said first elongate support member and being adapted to receive the fasteners for fastening said first elongate support member along a top edge of the container.

4. A flexible cover member for a recycle container as described in claim 3, wherein said first and second elongate support members have slots extending in the side edge of the first elongate support member and in the first side edge of the second elongate support member with the walls forming the slots being corrugated and with the end edges of the net member being securely retained in the respective slots thereof.

5. A flexible cover member for a recycle container as described in claim 4, wherein each of said elongate elastic members is woven through strands of mesh along a respective said side edge of said net member.

6. A flexible cover member for a recycle container as described in claim 5, wherein each of said fastening members includes a stem portion and a hook portion integrally extending therefrom, said stem portion being securely disposed in a longitudinal side edge of said second elongate support member, said fastening members essentially extending outwardly of said second elongate support member to effectively hook about a handle portion or lip portion of the container to secure said net member over the open top of the container.

7. A flexible cover member for a recycle container as described in claim 6, wherein said handle member is securely disposed in an intermediate portion of said side edge of said second elongate support member and extends outwardly therefrom to effectively allow a user to grasp and urge said net member over the open top of the container.

8. A flexible cover device for a recycle container comprising:

a net member being made of spaced mesh material;

a first elongate support member being securely attached along a first end edge of said net member and being adapted to be fastenable with fasteners upon a container, said first elongate support member including a plurality of holes spaced along and extending through said first elongate support member and being adapted to receive the fasteners for fastening said first elongate support member along a top edge of the container;

a second elongate support member being securely attached along a second end edge of said net member, said first and second elongate support members being essentially planar and having slots extending in the side edge of the first elongate support member and in the first side edge of the second elongate support member with the walls forming the slots being corrugated and with the end edges of the net member being securely retained in the respective slots thereof;

a plurality of elongate elastic members each of which is securely attached along a respective side edge of said net member and each of which has ends securely attached in said slots of said first and second elongate support members, each of said elongate elastic members being woven through strands of mesh along a respective said side edge of said net member;

fastening members spaced along and being securely attached to said second elongate support member and being adapted to fasten to a top of the container for securely disposing said net member upon an open top of the container, each of said fastening members including a stem portion and a hook portion integrally extending therefrom, said stem portion being securely disposed in a longitudinal side edge of said second elongate support member, said fastening members essentially extending outwardly of said second elongate support member to effectively hook about a handle portion or lip portion of the container to secure said net member over the open top of the container; and a handle member securely attached to said second elongate support member and extending therefrom, said handle member being securely disposed in an intermediate portion of said side edge of said second elongate support member and extending outwardly therefrom to effectively allow a user to grasp and urge said net member over the open top of the container.

* * * * *